US005553589A

United States Patent [19]

Middleton et al.

[11] Patent Number: 5,553,589

[45] Date of Patent: Sep. 10, 1996

[54] VARIABLE DROOP ENGINE SPEED CONTROL SYSTEM

[75] Inventors: Paul L. Middleton, Blaine, Minn.; John L. Zeller, Hiroshima, Japan

[73] Assignee: Cummins Electronics Company, Inc., Columbus, Ind.

[21] Appl. No.: 475,854

[22] Filed: Jun. 7, 1995

[51] Int. Cl.[6] ..... F02D 41/14; F02D 17/04; F02D 31/00

[52] U.S. Cl. ..... 123/352; 123/357

[58] Field of Search ..... 123/352, 357

[56] References Cited

U.S. PATENT DOCUMENTS

| | | | |
|---|---|---|---|
| 3,138,926 | 6/1964 | McCombs, Jr. | 60/39.281 |
| 3,393,691 | 7/1968 | Longstreet et al. | 137/48 |
| 3,412,648 | 11/1968 | Newburgh | 91/366 |
| 3,802,188 | 4/1974 | Barrett | 60/664 |
| 4,470,257 | 9/1984 | Wescott | 60/39.281 |
| 4,538,571 | 9/1985 | Buck et al. | 123/352 |
| 4,542,802 | 9/1985 | Garvey et al. | 180/306 |
| 4,709,335 | 11/1987 | Okamoto | 123/352 |
| 4,714,144 | 12/1987 | Speranza | 123/352 |
| 4,787,352 | 11/1988 | Anderson | 123/352 |
| 5,184,589 | 2/1993 | Nonaka | 123/352 |
| 5,235,512 | 8/1993 | Winkelman et al. | 123/352 |
| 5,253,626 | 10/1993 | Hatano et al. | 123/352 |
| 5,429,089 | 7/1995 | Thornberg et al. | 123/352 |

*Primary Examiner*—Willis R. Wolfe

*Attorney, Agent, or Firm*—Woodard, Emhardt, Naughton, Moriarty & McNett

[57] ABSTRACT

A variable droop engine speed control system includes a proportional-integral-derivative (PID) engine speed controller as its central component. The PID controller includes the standard proportional, integral and derivative gains associated with the proportional, integral and derivative portions of the controller, and further includes a droop gain associated only with the integral portion. The PID transfer function has a pole associated strictly with the droop gain such that a full range of droop may be provided by varying only the droop gain. Varying the droop gain affects only the steady-state frequency response of the PID so that its dynamic compensation is not disturbed by varying the amount of droop

19 Claims, 9 Drawing Sheets

VARIABLE DROOP ENGINE SPEED CONTROL SYSTEM

FIELD OF THE INVENTION

The present invention relates generally to systems for controlling engine speed in an internal combustion engine, and more specifically to such control systems permitting a change in engine speed in response to a change in engine load.

BACKGROUND OF THE INVENTION

Engine speed control systems, commonly known as engine speed governors, are well known in the automotive industry. In one type of engine speed governor, commonly used in passenger automobiles, the position of the throttle pedal roughly corresponds to the engine torque. To maintain constant vehicle speed with such a governor, the throttle position must be modulated in response to variations in road incline/decline to thereby correspondingly increase/decrease engine torque output. On a diesel truck engine, this type of throttle input is known as a "min-max" governor, owing to the functional features of limiting both the minimum and maximum engine speed, but with no regulation of speed between these limits.

Another type of engine speed governor, commonly used in diesel truck engines, is known as an "all-speed" governor, wherein the throttle position is equated to engine speed rather than engine torque. One variety of such an "all-speed" governor is known as an "isochronous" all-speed governor, wherein a constant engine speed is provided for a constant throttle position. With the isochronous governor, a cruise control function is thus provided wherein engine (and vehicle) speed will remain constant, regardless of load, if the throttle is held constant.

Referring to FIG. 1, an example of a known isochronous engine speed control system 10 is shown. A reference speed "REF SPEED", corresponding to a desired engine speed, is typically generated in response to throttle position. REF SPEED is provided to a positive input of a summing node 14. Summing node 14 also has a negative input which receives an ACTUAL SPEED as an output of an engine speed sensor 32 within the internal combustion engine 30. The output of summing node 14 thus provides a speed error signal "e" which corresponds to the difference between REF SPEED and ACTUAL SPEED. Speed error signal e is provided as an input to isochronous engine speed controller 16. The output 26 of controller 16 is then provided to the fueling system 28 to thereby fuel the engine 30 in accordance therewith.

P component 18 of isochronous engine controller 16 provides a "proportional" gain function for the speed error signal e, so that small fuel changes are made for small errors and larger fuel changes are made for larger errors. I component 20 provides an "integral" function for the speed error signal e, so that fuel changes are made slowly (and more smoothly) over time. The speed error correction function provided by engine speed controller 16 is thus not only proportional to the amount of speed error but also to the time that the error is present. Finally, D component 22 provides a "derivative" function for the speed error signal e, so that fuel changes may be accurately anticipated with respect to the direction and rate of change in e. The outputs of P 18, I 20 and D 22 are combined at summing node 24 to provide output fueling signal 26.

It should be pointed out that isochronous engine speed controller 16 is shown, in the example of FIG. 1, as three separate components: P, I and D, to facilitate the description thereof. It is to be understood that in practice, components P, I and D are functionally merged into one component; either as a physical controller 16 or as a software function executable by, for example, a microprocessor. The resulting proportional-integral-derivative (PID) controller 16 is well known in the automotive industry.

Referring now to FIG. 2, the frequency response, or bode plot, of a typical isochronous PID controller 16 is shown. FIG. 2A shows the gain of controller 16 at each frequency. The Magnitude 36 (in dB) of the gain of controller 16 is given by the equation Magnitude=20 * $\log_{10}(g)$. Similarly, FIG. 2B shows the Phase 38 at each frequency. Generally, negative Phase numbers indicate delay between the speed error signal e and the output signal 26 of controller 16, and positive Phase numbers indicate anticipation by the output signal 26 of the speed error signal e. As is known in the art, more delay (more negative Phase) generally makes a system more difficult to control (ie. more difficult to achieve system stability).

In a bode plot such as that shown in FIG. 2, the Magnitude 36 may be approximated as a set of straight lines and corners. The "poles" and "zeros" of the controller 16 correspond to those frequencies at which the Magnitude 36 has a "corner", where the left-most portion of the Magnitude 36 is considered to be a corner but the right-most portion is not. Generally, a pole occurs at a corner that bends the graph down and a zero occurs at a corner that bends the graph up. From FIG. 2A, controller 16 thus has poles at approximately 0 Hz and 80 Hz, and zeros at approximately 1 Hz and 10 Hz.

Typically, a PID controller is defined as a transfer function having poles and zeros. Using the known z-plane representation of discrete-time systems commonly used with controllers under microprocessor control, such a transfer function is a ratio of polynomials in z where the order of each polynomial is equal to the number of corresponding poles and zeros. The roots of the denominator of such a transfer function then correspond to the poles of the controller while the roots of the numerator correspond to the zeros of the controller. Generally, conversion between the frequency domain and the z domain follows the equation Frequency= $\ln(z)/(2\pi T_S)$ where $T_S$ is the sampling period of the controller. Thus, for a sampling period of approximately 2 milliseconds, the transfer function $H_1$ of the PID controller example given in FIGS. 1 and 2 may be represented by the equation:

$$H_1=[4.5(z-0.988)(z-0.882)]/[(z-1)(z-0.366)].$$

A strictly isochronous all-speed governor, such as system 10, is not normally used for on-highway applications due to drivability problems. Specifically, since small changes in throttle position correspond to large changes in engine torque in such systems, it is difficult to operate a vehicle smoothly using such a governor. For this reason, isochronous governors are typically provided with a so-called "droop" function, where droop can be defined as a governor characteristic that permits the steady state engine speed to decrease slightly as engine load increases. A common measure of droop is scaled in percent and defined by the equation:

$$\%\ \text{Droop}=[(\text{nlspeed}-\text{flspeed})/\text{flspeed}]*100,$$

where nlspeed is the no-load (or zero load) engine speed and flspeed is the full-load engine speed. By this measure, a strictly isochronous governor has zero percent droop. Similarly, if droop is increase enough, the governor performs like a min-max governor.

Droop is a steady state requirement, meaning that with a steady load on the engine, the engine speed correspondingly decreases. This implies that the controller 16 must have a small gain at low frequencies to match the desired droop function. As droop is decreased, to operate more like an isochronous engine speed controller, the low frequency gain must thus increase as well. In fact, ideal isochronous operation (zero percent droop), requires the low frequency gain to be infinite.

Referring now to FIG. 3, a prior art modified isochronous engine speed control system 15 is shown which is identical in some respects to the isochronous engine speed control system 10 of FIG. 1. As such, like numbers are used to represent like components. However, engine speed control system 15 includes an additional feedback path between the PID controller 16 output and the REF SPEED input. Specifically, gain block 40 receives the output signal 26 of PID controller 16, multiplies this signal by a gain $G_D$ and subtracts this signal from REF SPEED at summing node 42. Summing node 14 thus receives an altered REF' SPEED signal at its positive input. The operational effect of including gain block 40 is to achieve the goals of providing the engine speed control system 15 with droop capability while maintaining a stable system.

Referring now to FIG. 4, a bode plot of engine speed control system 15 is shown along with that of engine speed control system 10. As shown in FIG. 4A, adding gain block 40 reduces the low frequency gain 44 as desired. Referring to both FIGS. 4A and 4B, however, although system stability is maintained (no sustained oscillation), both high frequency gain 44 and phase 46 are affected by the addition of gain block 40. In particular, the phase 46 is more negative at high frequencies which has the effect of adding more delay to the system, thereby creating stability problems attributable to gain block 40. Thus, as more droop is introduced into system 15, by increasing the gain $G_D$ of gain block 40, the system 15 becomes less stable.

Adding feedback gain block 40 results in the following transfer function $H_2$ attributable to PID controller 16:

$$H_2=[4.5(z-0.988)\ (z-0.882)z]/[(z-0.9987)\ (z-0.670)\ (z+0.586)].$$

Comparison of the poles and zeros in $H_2$ to the poles and zeros of $H_1$ indicates the effects of adding gain block 40. First, the pole at z=1 in $H_1$ has moved slightly to z=0.9987 in $H_2$, which introduces the increased droop effect. Also, the pole at z=0.366 in $H_1$ has moved to z=0.670, and is responsible for the loss of phase at high frequencies. Finally, the addition of gain block 40 has introduced another pole and zero in $H_2$. The pole so introduced at z=−0.586 is responsible for the large gain and phase fluctuations at very high frequencies.

Within system 15, it is apparent that adding gain block 40 introduces more to engine speed control system 15 than droop capability. High frequency variations are also introduced that may require gains internal to the PID controller 16 to be adjusted for different levels of $G_D$ in order to maintain system 15 stability. Moreover, system 15 is limited in the amount of droop that can be obtained. For example, it has been determined through experimentation that one such system 15 becomes unstable for droop levels above approximately 24%. What is therefore needed is a new technique for varying droop in an engine speed control system wherein the droop percentage may be varied without limitation while maintaining system stability.

SUMMARY OF THE INVENTION

The shortcomings of the prior art engine speed control systems are addressed by the present invention. According to one aspect of the present invention, a method of controlling the engine speed of an internal combustion engine having a throttle position sensor associated therewith for sensing throttle position, an engine speed sensor for sensing actual engine speed, and a fuel system responsive to a fuel control signal to fuel the engine, comprises the steps of: (1) sensing throttle position and determining a desired engine speed therefrom; (2) sensing actual engine speed; (3) determining an error speed to be the difference between the desired engine speed and the actual engine speed; (4) generating a fuel control signal from the error speed that is a function of at least the magnitude, duration and rate of change of the error speed, the fuel control signal further being proportional to engine load such that the actual engine speed decreases as engine load increases; and (5) fueling the engine in accordance with the fuel control signal to thereby control the actual engine speed.

In accordance with another aspect of the present invention, a method of providing variable droop in an electronic engine speed governor having a proportional portion, an integral portion and a derivative portion associated therewith, the governor having a transfer function that is a function of the proportional, integral and derivative portions, comprises the steps of: (1) configuring the governor such that its transfer function has a pole associated with the integral portion; (2) providing the integral portion with a droop gain associated with the integral portion pole; and (3) varying the magnitude of the droop gain to thereby vary the location of the integral portion pole, the location of the integral portion pole determining the amount of droop in the engine speed governor. The engine speed governor further has a frequency response associated therewith, in which case the method may comprise the steps of: (1) configuring the governor such that the magnitude of only its steady-state frequency response is dependent upon a droop gain associated with the integral portion; and (2) varying the magnitude of the droop gain to thereby vary the steady state frequency response magnitude, the magnitude of the steady-state frequency response determining the amount of droop in the engine speed governor.

In accordance with a further aspect of the present invention, a control system for controlling the speed of an internal combustion engine having a throttle comprises a throttle position sensor for sensing throttle position and providing a throttle position signal corresponding thereto, an engine speed sensor for sensing engine speed and providing an engine speed signal corresponding thereto; a fueling system responsive to a fuel control signal to fuel the engine; and an engine speed controller. The engine speed controller is responsive to the throttle position signal to provide a reference speed signal corresponding thereto. The engine speed controller is further responsive to the reference speed signal and the engine speed signal to determine an error speed signal corresponding to the difference therebetween. Finally, the engine speed controller is responsive to the error speed signal to generate the fuel control signal from the error speed signal, wherein the fuel control signal is a function of at least the magnitude, duration and rate of change of tile error speed signal, and is further proportional to engine load such that the engine speed decreases as engine load increases.

According to yet another aspect of the present invention, a variable droop electronic engine speed governor for use in a control system for controlling the speed of an internal combustion engine, comprises an error speed input for receiving an engine speed error signal thereat; a fuel control output for providing a fuel control signal thereat; and an engine speed error correction portion defining a transfer function having at least one pole. The location of the pole is variable to thereby provide the governor with a variable range of droop. The engine speed governor is responsive to the engine speed error signal to provide the fuel control signal to the engine fueling system in accordance with the transfer function. The engine speed error correction portion further has a frequency response associated therewith, wherein the magnitude of only the steady-state portion of the frequency response is variable to thereby provide the engine speed governor with a correspondingly variable range of droop. In this case, the engine speed governor is responsive to the engine speed error signal to provide the fuel control signal to the engine fueling system in accordance with the frequency response.

One object of the present invention is to provide a control system for controlling the speed of an internal combustion engine wherein the engine speed controller includes an internal variable droop gain for providing a correspondingly variable amount of droop.

Another object of the present invention is to provide such a control system wherein varying the internal droop gain does not affect the dynamic compensation of the engine speed controller.

These and other objects of the present invention will become more apparent from the following description of the preferred embodiment.

DESCRIPTION OF THE PREFERRED EMBODIMENT

Figure 1:
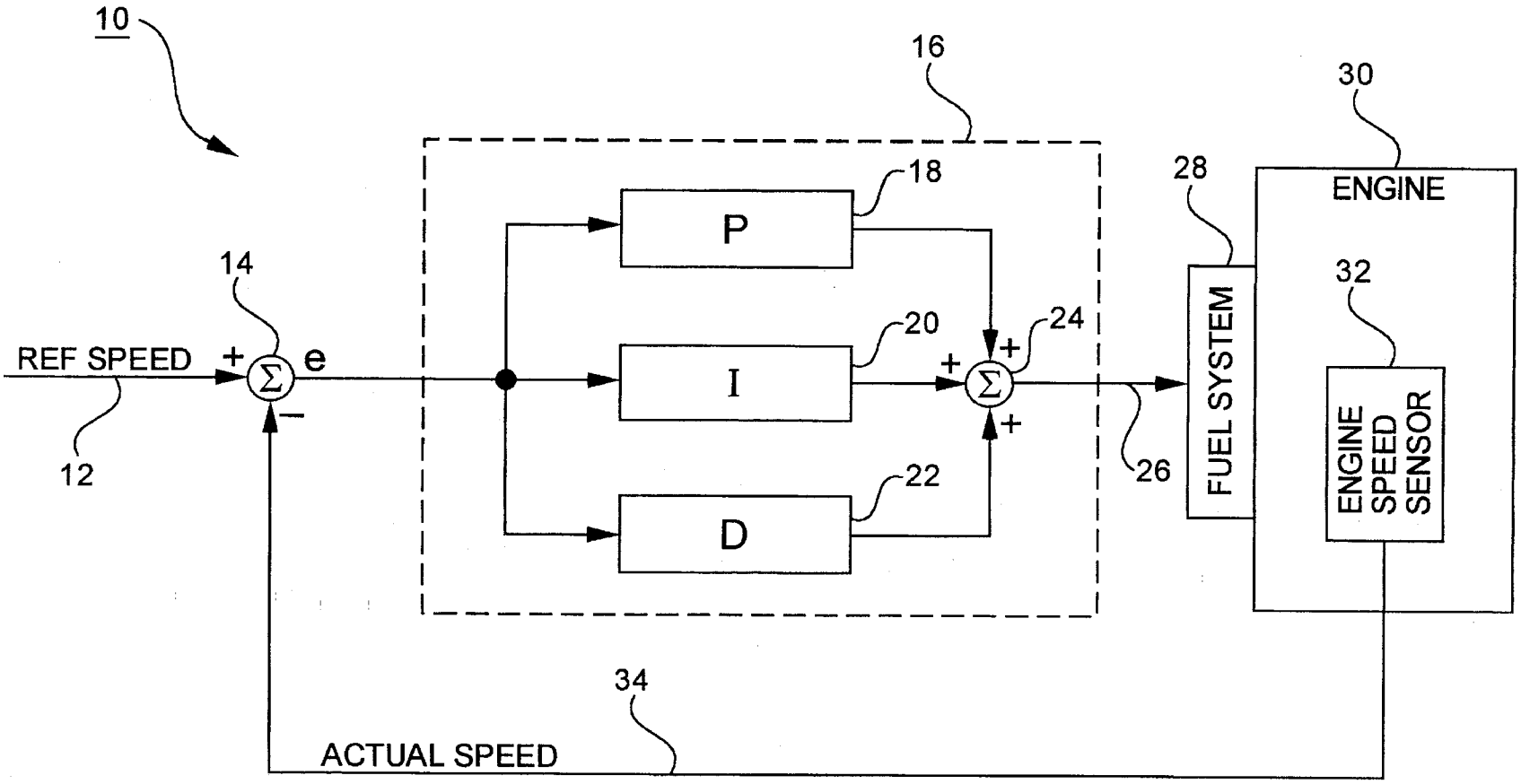
Fig. 1 (PRIOR ART)
FIG. 1 is a block diagram schematic of a prior art isochronous engine speed control system incorporating a PID governor therein.
Figure 2A:
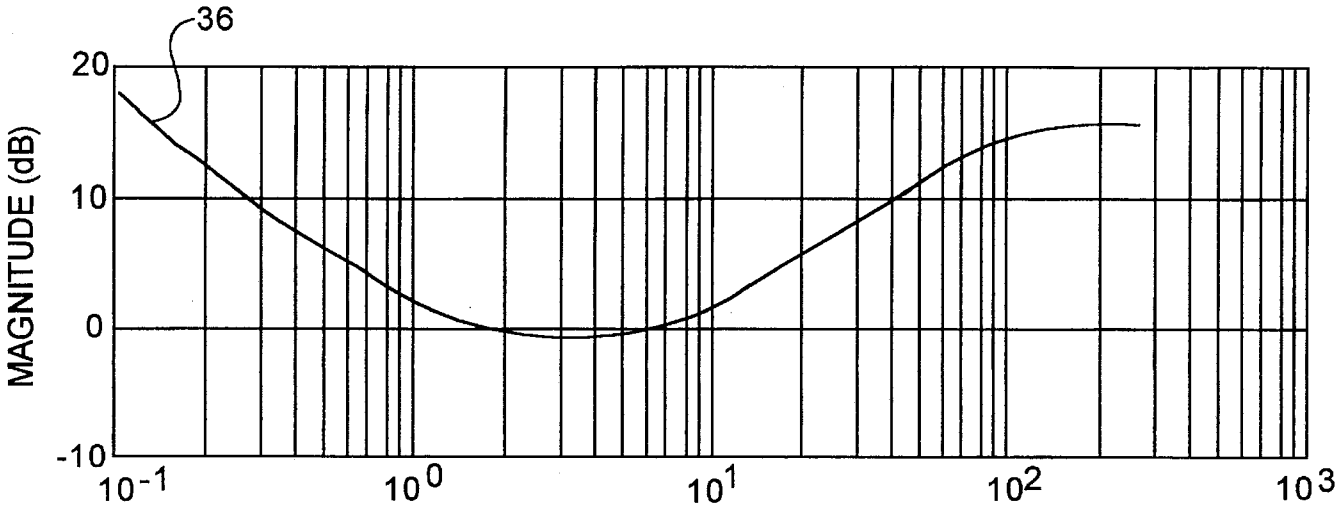
Fig. 2A (PRIOR ART)
FIGS. 2A and 2B are plots of the frequency response of the engine speed control system of FIG. 1.
Figure 2B:
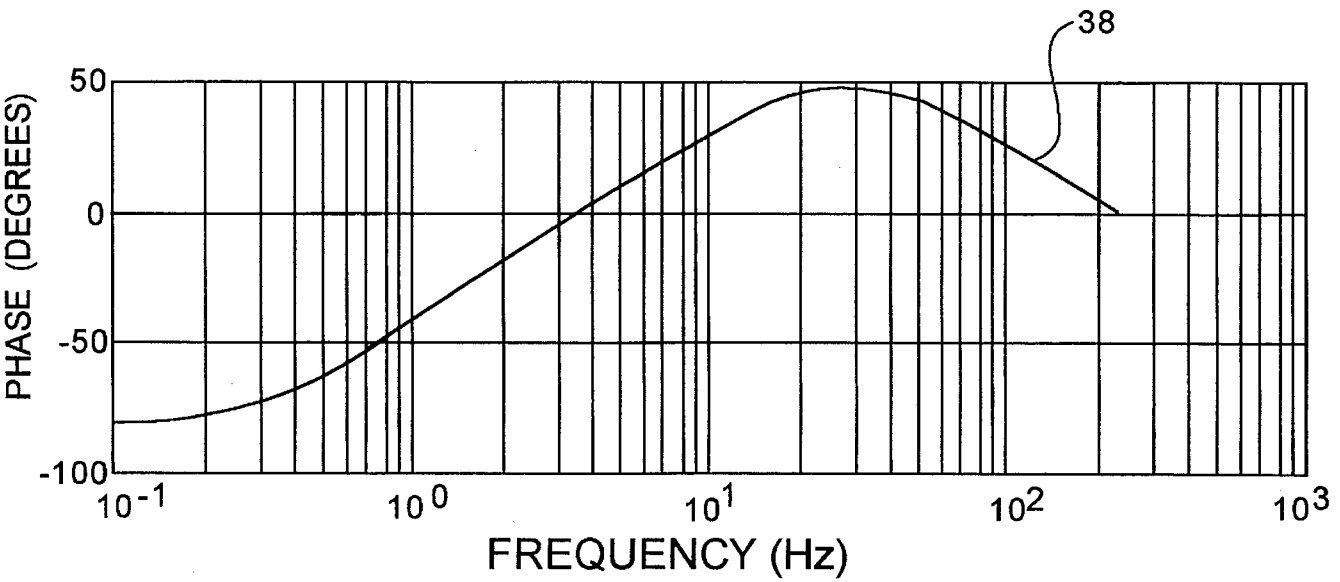
Fig. 2B (PRIOR ART)

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Figure 3:
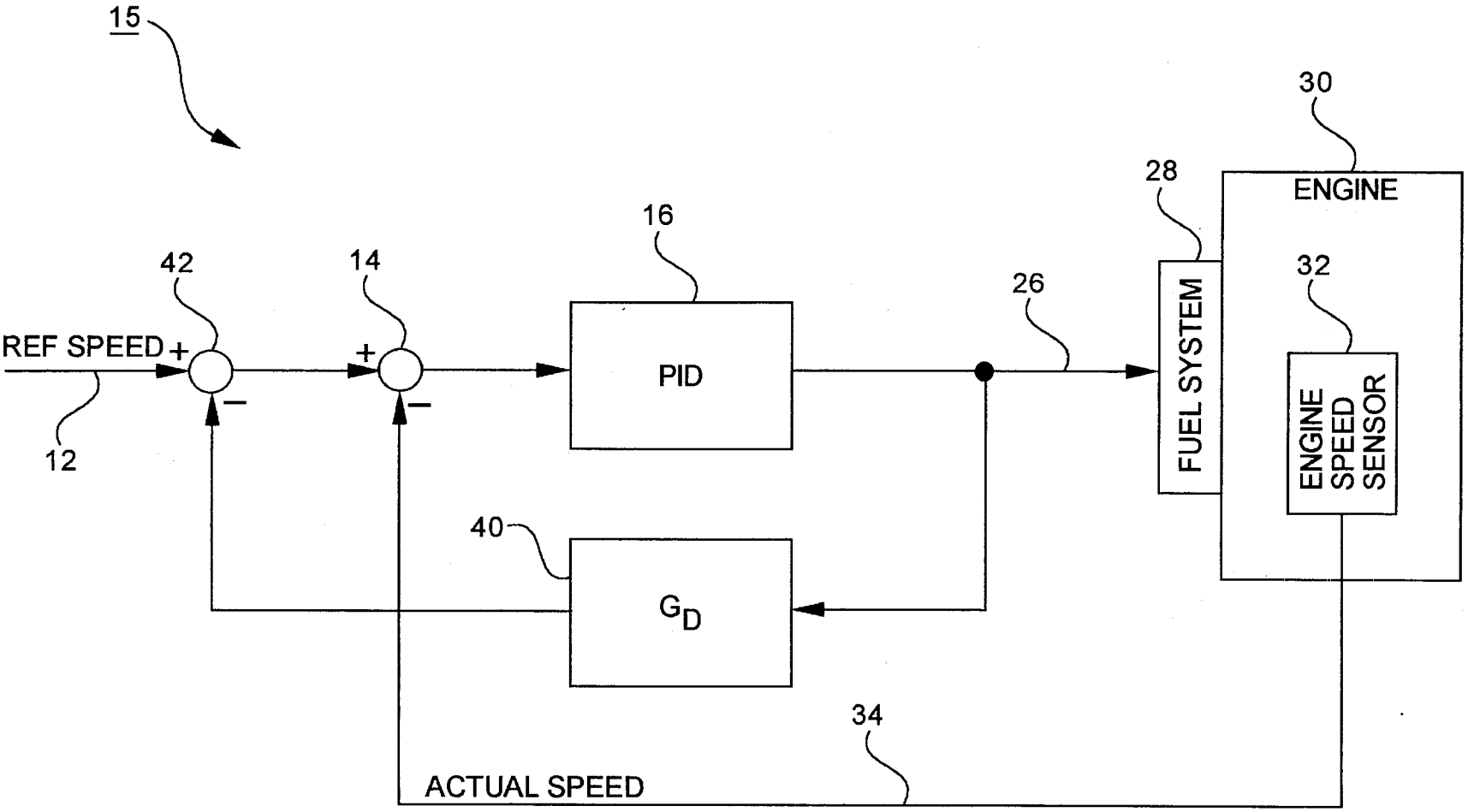
Fig. 3 (PRIOR ART)
FIG. 3 is a block diagram schematic of a prior art isochronous engine speed control system similar to that of FIG. 1 with variable droop capability.
Figure 4A:
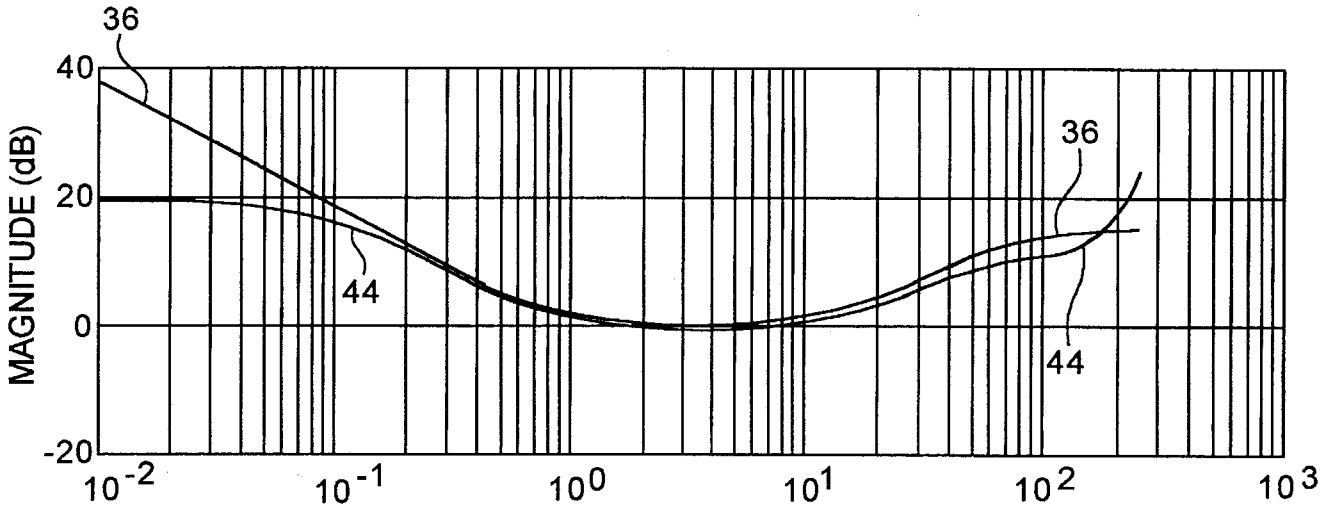
Fig. 4A (PRIOR ART)
FIGS. 4A and 4B are plots of the frequency response of the engine speed control system of FIG. 3.
Figure 4B:
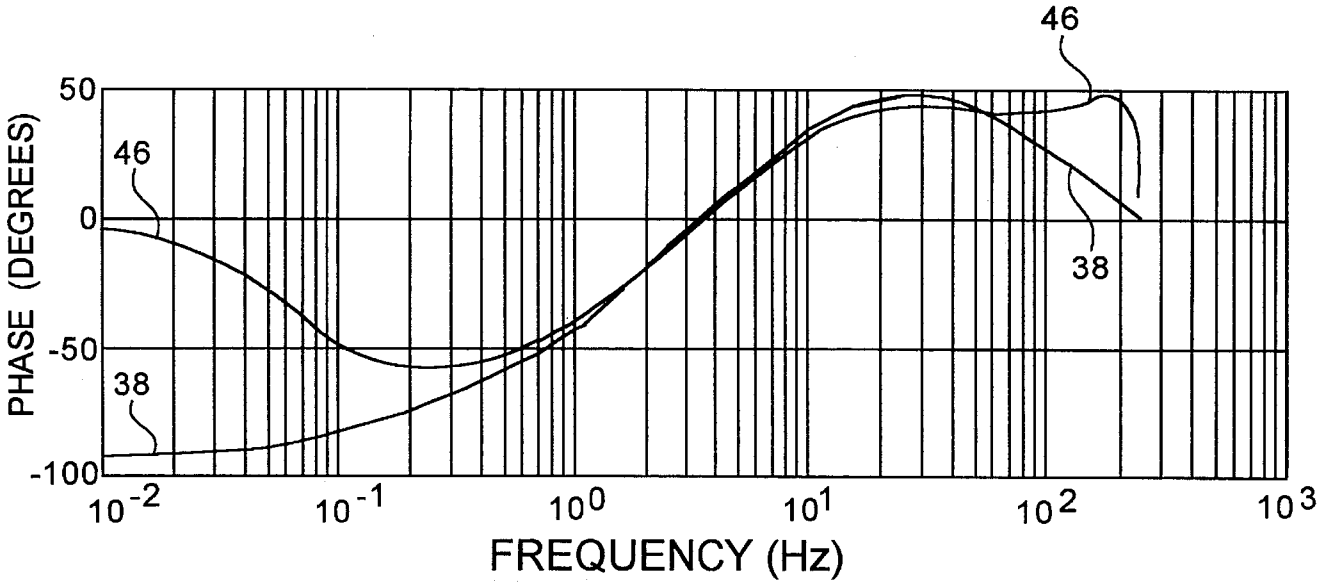
Fig. 4B (PRIOR ART)
Figure 5A:
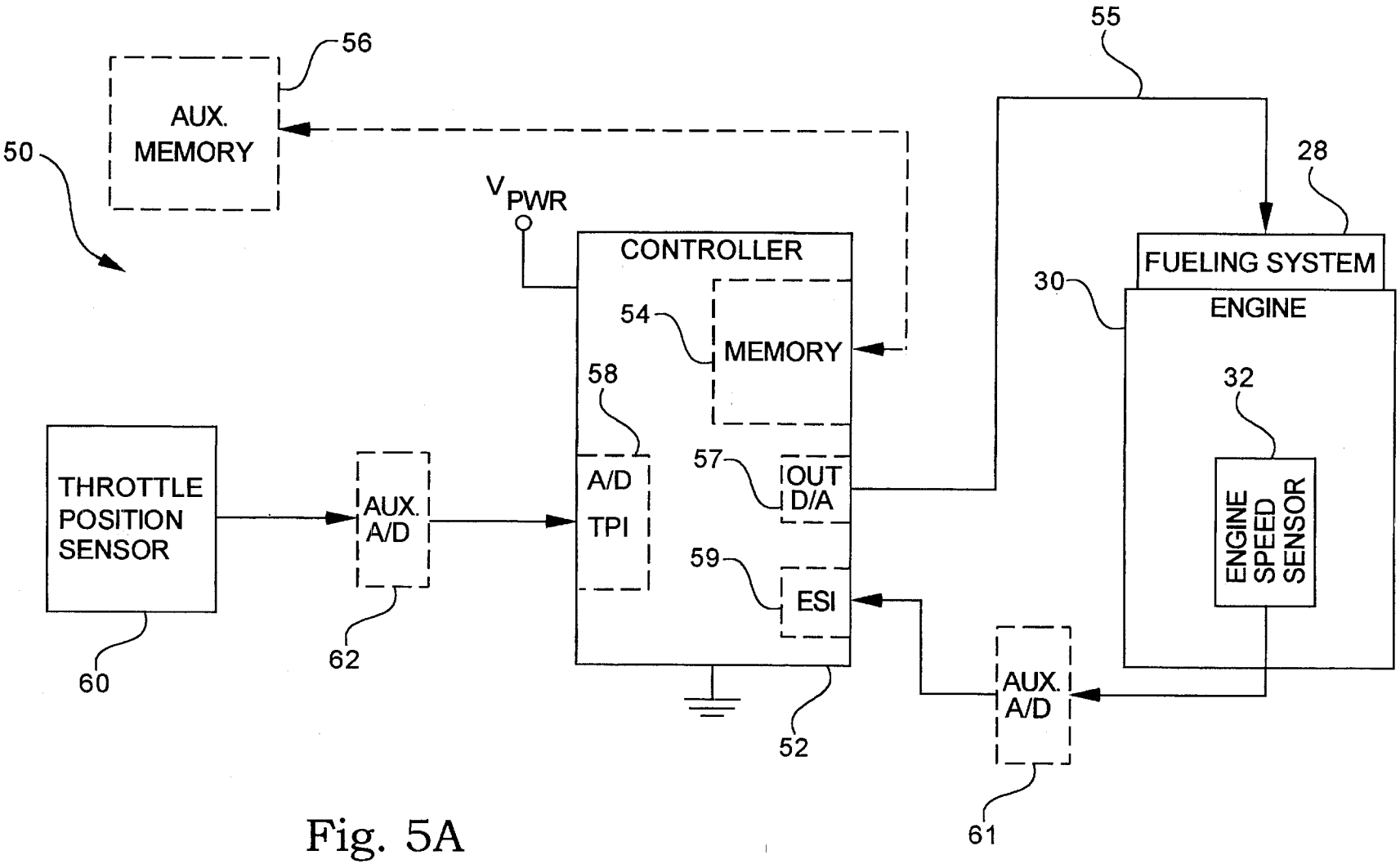
FIG. 5A is a block diagram schematic of one embodiment of a variable droop engine speed control system in accordance with the present invention.

Referring now to FIG. 5A, one embodiment of an engine speed control system 50, in accordance with the present invention, is shown. Several of the components within system 50 are identical to those described with respect to FIGS. 1 and 3, and like reference numbers will therefore be used to identify like components.

Central to system 50 is the controller 52. Controller 52 may represent an Electronic Control Module (ECM) of the type typically implemented in the automotive industry. Alternatively, controller 52 may be a microprocessor-based controller, such as an Intel 80196, or a microprocessor capable of executing an engine speed control algorithm of the type to be discussed hereinafter. In any event, controller 52 is powered by a voltage $V_{pwr}$ which is typically supplied either directly from a battery voltage of between approximately 7.0 and 32.0 volts, or via a voltage regulator having a regulated voltage of between approximately 3.0 and 7.0 volts.

Preferably, controller 52 includes a memory portion 54 which may be supplemented by an external auxiliary memory 56. Alternatively, controller 52 may be supplied without memory portion 54 so that auxiliary memory 56 will be necessary to store information required by controller 52. Regardless of the memory arrangement, memory portion 54 and/or auxiliary memory 56 must be capable of storing data accessible by controller 52 as well as software algorithms executable by controller 52. Preferably, memory portion 54 and/or auxiliary memory 56 includes a random-access-memory (RAM) as well as a read-only-memory (ROM), such as a programmable ROM (PROM), erasable PROM (EPROM), electrically erasable PROM (EEPROM), or flash PROM, although other memory types are contemplated such as magnetically or optically accessible memories.

Preferably, controller 52 further includes an analog-to-digital (A/D) conversion portion 58 for receiving analog inputs and converting the analog signals to digital signals for use by controller 52. Alternatively, controller 52 may be supplied without A/D portion 58 so that an external A/D convertor 62 will be required to convert analog signals to digital signals prior to being received by controller 52. Controller 52 further has a throttle position input (TPI) for receiving a throttle position signal from a throttle position sensor 60. The throttle position signal is preferably an analog signal corresponding to the position of the accelerator pedal of the vehicle (not shown). The throttle position signal is therefore converted to a digital signal for use by controller 52 by either A/D portion 58 or external A/D convertor 62. However, the present invention further contemplates that throttle position sensor 60 may provide a digital signal corresponding to the position of the accelerator pedal so that neither A/D portion 58 nor A/D convertor 62 are needed.

within engine speed control system 50, the engine speed governor functions described with respect to FIGS. 1–4, such as summing node 14 and PID controller 16, are contained within controller 52. As will be explained in greater detail hereinafter, the governor functions are implemented as a software algorithm within controller 52 to produce a PI'D function. With such an arrangement, controller 52 receives an engine speed signal, corresponding to actual engine speed, from engine speed sensor 32 located within the engine 30, at an engine speed input (ESI). As with the throttle position signal, the engine speed signal is an analog signal provided by the engine speed sensor 32. As such, controller 52 requires a second A/D portion 59 for converting the analog engine speed signal to a digital engine speed signal for use by controller 52. Alternatively, controller 52 may be provided without an A/D portion 59 and a second auxiliary A/D convertor 61 may be provided external to controller 52 to perform this function. Finally, as with throttle position sensor 60, the present invention contemplates that engine speed sensor 32 may provide a digital engine speed signal so that neither A/D portion 59 nor auxiliary A/D convertor 61 are required. Finally, controller 52 further has an output OUT which supplies a fuel control signal 55, corresponding to governed engine speed, to fueling system 28 of engine 30.

Figure 5B:
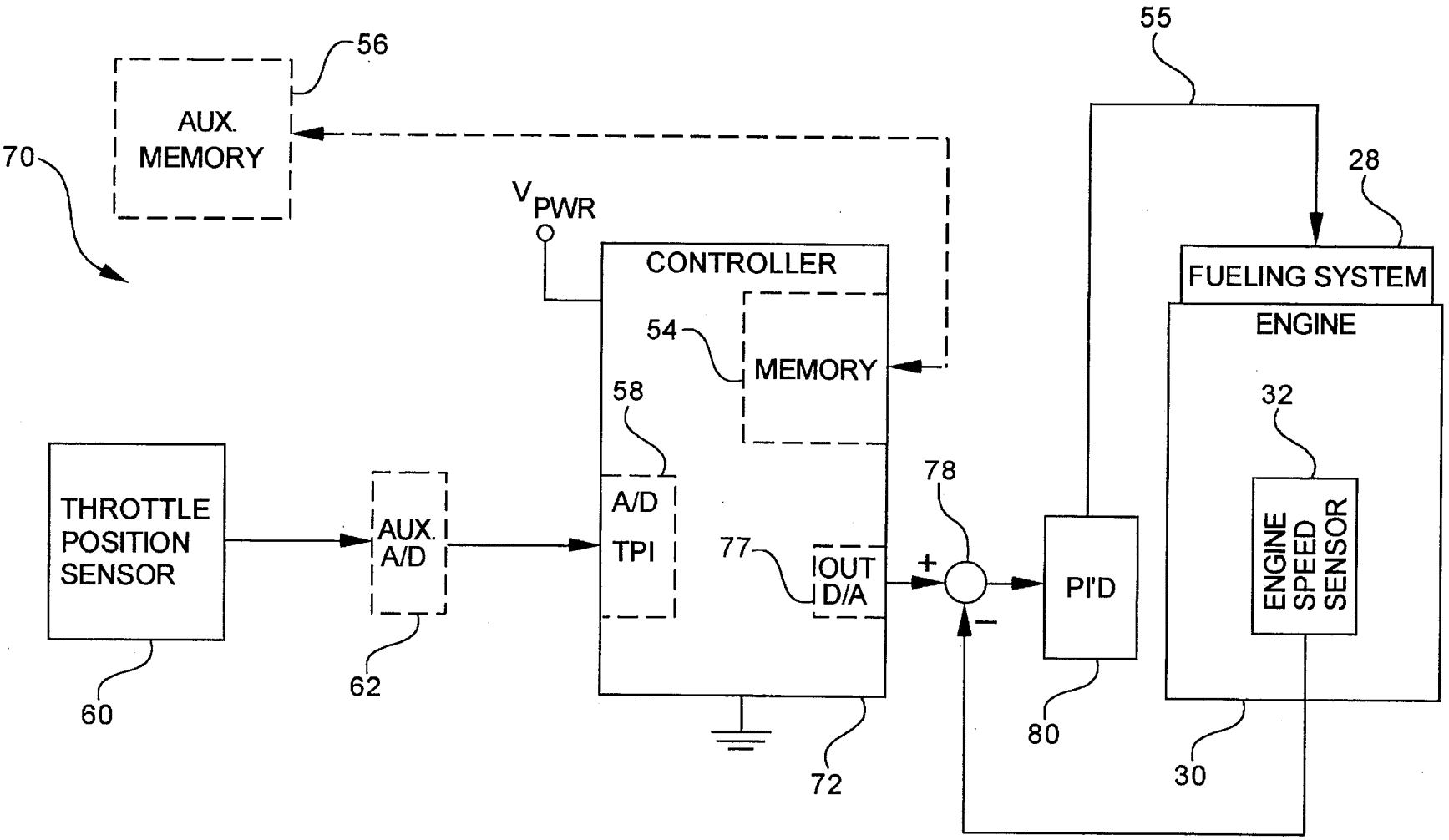
FIG. 5B is a block diagram schematic of another embodiment of a variable droop engine speed control system in accordance with the present invention.

Referring now to FIG. 5B, another embodiment of an engine speed control system 70, in accordance with the present invention, is shown. Several of the components within system 70 are identical to those described with respect to FIGS. 1, 3 and 5A, and like reference numbers will therefore be used to identify like components.

System 70 is identical in most respects to system 50 of FIG. 5A except that summing node 78 and PI'D controller 80 are components external to controller 72. Controller 72 thus does not require input ESI or A/D portion 59 (or auxiliary A/D convertor 61), and has an output OUT connected to summing node 78. Summing node 78 is, in turn, connected to PI'D controller 80 which supplies a fuel control signal to fueling system 28 of engine 30. Both PI'D controller 80 (FIG. 5B) and the PI'D function contained within a software algorithm executable by controller 52 (FIG. 5A) are similar in many respects to PI'D controller 16 of FIGS. 1 and 3, except that the integral portion thereof has been modified to provide a full range of droop as will be fully described hereinafter. Alternatively, system 70 need not be controlled by controller 72, and the analog output from the throttle position sensor 60 may be fed directly to summing circuit 78. With system 70 so configured, a purely analog PI'D control system may be realized.

Figure 6:
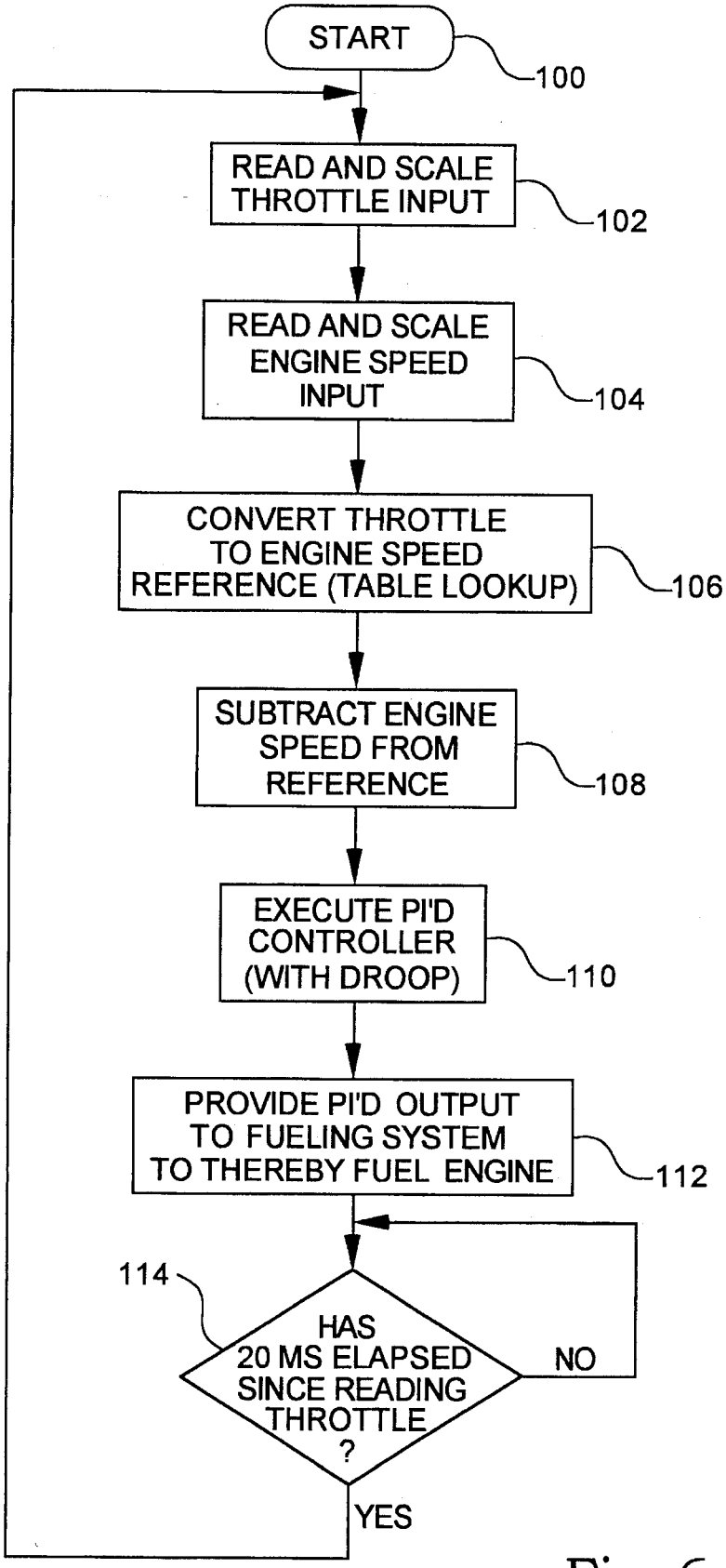
FIG. 6 is a flow chart of an algorithm for controlling engine speed in accordance with the engine speed control system of FIG. 5A or FIG. 5B.

Referring now to the flowchart of FIG. 6, the operation of the engine speed control system 50 or 70 of the present invention will now be described in detail. The flowchart of FIG. 6 represents the flow of a software program or algorithm executable by either controller 52 or 72 in controlling the engine speed of engine 30- Program execution begins at step 100 and at step 102, the throttle position signal provided by throttle position sensor 60 is read at input TPI. If the throttle position signal is an analog signal, the signal is scaled, or converted to digital form, by A/D portion 58 (or alternatively, A/D convertor 62). If the throttle position signal is a digital signal, A/D portion 58 (or alternatively A/D convertor 62) is omitted and the digital throttle position signal is simply read by controller 52 (or 72) at input TPI. Program execution continues from step 102 at step 104 where the engine speed signal provided by engine speed sensor 32 is read. In engine speed control system 50 (FIG. 5A), step 104 corresponds to reading the engine speed signal at input ESI. If the engine speed signal is an analog signal, the signal is scaled, or converted to digital form, by A/D portion 59 (or alternatively, A/D convertor 61). If the engine speed signal is a digital signal, A/D portion 59 (or alternatively A/D convertor 61) is omitted and the digital throttle position signal is simply read by controller 52 at input ESI. Alternatively, in engine speed control system 70 (FIG. 5B), step 104 corresponds to receiving the engine speed signal from engine speed sensor 32 at a negative input of summing node 78.

Program execution continues from step 104 at step 106 where the throttle position signal is converted to a reference speed signal, corresponding to a desired engine speed, within controller 52 (or 72). Preferably, this conversion is accomplished with a lookup table as is known in the computer art. Essentially, the lookup table is a cross-reference tool containing a corresponding engine speed value for every digital throttle position value.

From step 106, program execution continues at step 108 where the actual engine speed from step 104 is subtracted from the reference speed determined in step 106 to produce an error speed. In system 50 (FIG. 5A), step 108 is performed within controller 52 as an executable arithmetic operation. Within system 70 (FIG. 5B), however, the reference engine speed is provided at output OUT of controller 72 to a positive input of summing node 78. Step 108 is thus performed automatically in system 70 by summing node 78. Since the engine speed signal is preferably an analog signal, controller 72 includes a digital-to-analog (D/A) conversion portion 77 for converting the digital reference speed to an analog speed. Although not shown in FIG. 5B, it is to be understood that controller 72 need not be supplied with a D/A portion 77 and this function may be provided by an auxiliary D/A convertor external to controller 72. Alternatively, summing node 78 may include such a D/A convertor.

Program execution continues from step 108 at step 110 where the PI'D controller function is executed to produce a fuel control signal from the error speed signal. In system 50 (FIG. 5A), the PI'D controller function is executed as a software function within controller 52. In system 70 (FIG. 5B), the PI'D function is executed by PI'D controller 80. The preferred PI'D function form, as well as a preferred embodiment thereof, will be discussed in greater detail hereinafter.

Program execution continues from step 110 at step 112 where a fuel control signal 55 in the form of an engine torque command is provided at the output of the PI'D controller. In system 50 (FIG. 5A), step 112 corresponds to providing the engine torque command to the engine fueling system 28 at output OUT. The engine torque command is preferably an analog signal so that controller 52, like controller 72, includes a digital-to-analog (D/A) conversion portion 57. In controller 52, however, D/A conversion portion 57 converts the digital engine torque command to an analog signal. Although not shown in FIG. 5A, it is to be understood that controller 52 need not be supplied with a D/A portion 57 and this function may be provided by an auxiliary D/A convertor external to controller 52. Alternatively, fueling system 28 may include such a D/A convertor. In system 70 (FIG. 5B), step 112 corresponds to providing the fuel control signal 55 to the engine fueling system 28 at the output of the PI'D 80. In either case, the fuel control signal 55 directs the fuel system actuators (not shown) within fueling system 28 to fuel the engine 30 in accordance with the PI'D torque command to thereby control the actual engine speed.

The foregoing algorithm is executed several times per second, and in a preferred embodiment, is executed every 20 milliseconds. Program execution thus continues from step 112 at step 114 where controller 52 (or 72) tests whether 20 milliseconds have elapsed since step 102. If not, the algorithm loops back to step 114. If, and when, 20 milliseconds have elapsed since step 102, the algorithm loops back to step 102 to restart the algorithm.

Referring again to step 110 of the flowchart of FIG. 6, the PI'D function executable as a software function by controller 52 (FIG- 5A), or by PI'D controller 80 (FIG. 5B) will now be described in detail. In order to provide a full range of droop with a PID controller such as PID controller 16 shown in FIGS. 1 and 3, it is necessary to modify the integral portion thereof to provide a droop gain at the pole of the transfer function corresponding to the integral portion of the PID controller. Doing so permits droop to be varied by varying only the amount of droop gain. An example of such a modification of PID controller 16 to provide PI'D controller 80 (or the PI'D function executable within controller 52) can be observed by inspection of the resulting transfer PI'D function $H_3$:

$$H_3=[4.5(z-0.988)(z-0.882)]/[(z-0.9990)\ (z-0.366)].$$

Figure 7A:
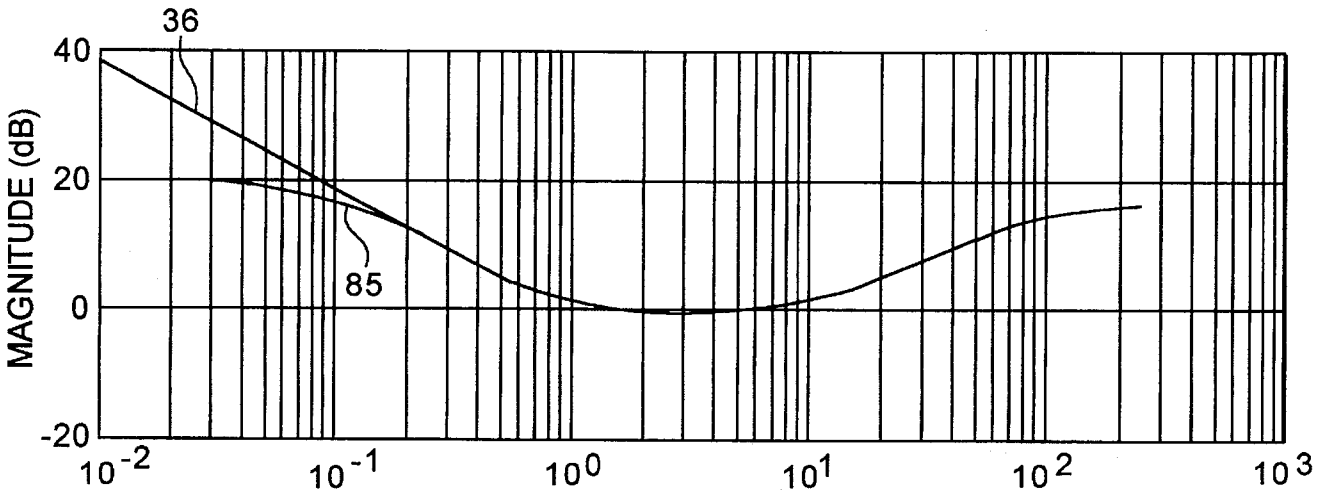
FIGS. 7A and 7B are plots of the frequency response of the engine speed control system of either FIG. 5A or FIG. 5B.
Figure 7B:
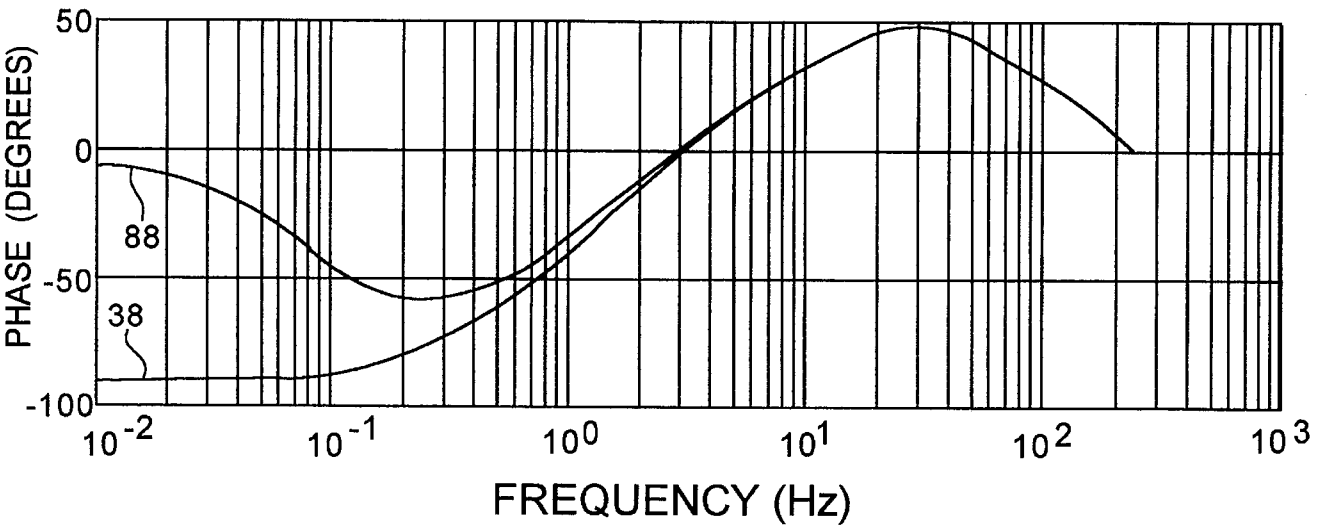

The transfer function $H_3$ is thus identical to the transfer function $H_1$ with the exception that the pole originally at z=1 has been moved to z=0.9990. As with PID controller 16, the fuel control signal provided by the PI'D controller is a function of the magnitude of the error speed (proportional), the duration of the error speed (integral), as well as the direction and rate of change of the error speed (derivative)- However, since the PI'D controller includes a newly introduced droop gain, the fuel control signal provided by the PI'D controller is also proportional to engine load such that the actual engine speed decreases as engine load increases The resulting frequency response of the PI'D controller of the present invention is shown in the bode plot of FIG. 7 along with the frequency response of PID controller 16 (FIG. 1). Referring to FIG. 7A, the magnitude 85 of the steady-state portion of the frequency response is decreased by introducing the droop gain into the integral portion of the PID controller 16, where "steady- state", for the purposes of this specification, is defined as frequencies of less than approximately one (1) Hz. The dynamic frequency response, on the other hand, is identical to the dynamic response 36 of PID controller 16, where "dynamic" for the purposes of this specification, is defined as frequencies greater than approximately one (1) Hz. The phase response 88 (FIG. 7B) is similarly only affected (made more positive) in the steady state and matches the phase response 38 of PID controller 16 at dynamic frequencies. Increasing the droop gain has the effect of moving the integral portion pole away from, and less than, 1.0, which also has the effect of decreasing only the steady state frequency response magnitude. Increasing the droop gain, on the other hand, has the effect of moving the integral portion pole toward 1.0, which also has the effect of increasing only the steady state frequency response magnitude. Thus, by modifying the integral portion of PID controller 16 to provide a droop gain associated with the integral portion pole originally at z=1, a new PI'D controller (80 in FIG. 5B and internal to controller 52 in FIG. 5A) is formed. The resulting PI'D controller has additional droop capability over control system 15 of FIG. 3 (see bode plot of FIG. 4), but does not suffer from the previously discussed ill effects of system 15 observed at the higher :frequencies. With the PI'D controller, zero droop can be implemented to achieve strictly isochronous behavior by moving the location of the integral portion pole closer to z=1.0, which corresponds to increasing the newly introduced droop gain. Conversely, a desired ratio of engine speed decrease to engine load increase can be provided, without affecting system stability, by moving the integral portion pole away from, and less than, 1.0, which corresponds to decreasing the droop gain. A full range of droop can thus be realized with the PI'D controller.

Figure 8:
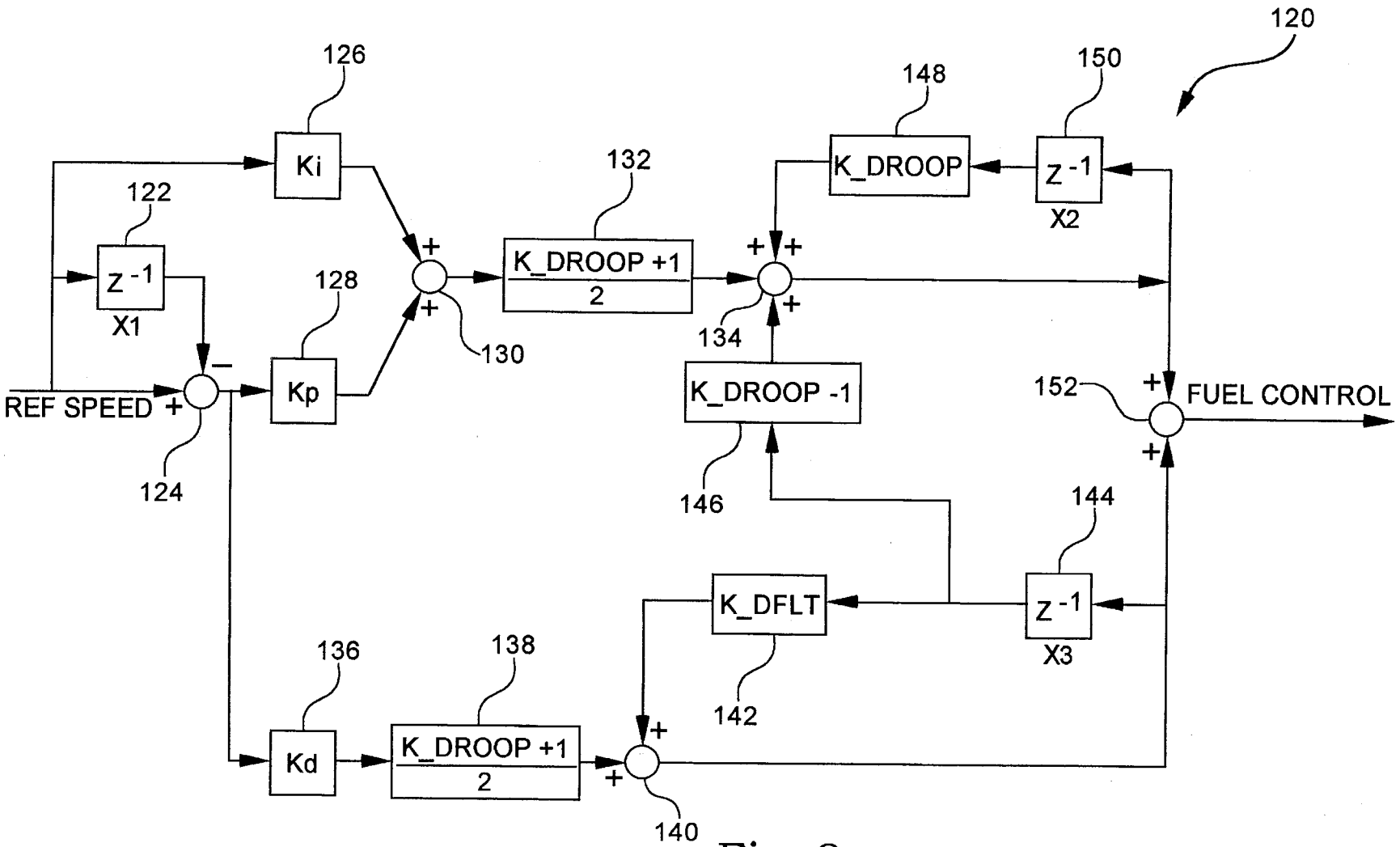
FIG. 8 is a block diagram schematic of one embodiment of the internal structure of the engine speed controller of either of FIGS. 5A or 5B.

Referring now to FIG. 8, a block diagram schematic of one embodiment 120 of the internal structure of PI'D controller (80 of FIG. 5B, and internal to controller 52 in FIG. 5A). Within PI'D controller 120, the reference engine speed REF SPEED is provided to a delay block 122 and thereafter to a negative input of summing node 124. Additionally, REF SPEED is supplied to a positive input of summing node 124. REF SPEED is further supplied to a gain block $K_i$, corresponding to the integral gain commonly known with respect to PID controller 16. The output of summing node 124 is similarly supplied to gain blocks $K_p$ 128 and $K_d$ 136, corresponding to the proportional and derivative gains respectively, also commonly known with respect to PID controller 16.

The signals from $K_i$ 126 and $K_p$ 128 are supplied to positive inputs of summing node 130. The output of summing node 130 is supplied to a gain block 132 having a gain defined by the equation (K_DROOP+1)/2, where K_DROOP is the newly introduced droop gain. The signal from droop gain block 132 is provided to a positive input of summing node 134. The output of summing node 134 is supplied to a positive input of output summing node 152 and to a delay block 150. The output of delay block 150 is supplied to a droop gain block 148 having a gain K_DROOP, and is thereafter supplied to another positive input of summing node 134.

The output of the $K_d$ gain block 136 is supplied to a droop gain block 138 having a gain defined by the equation (K_DROOP+1)/2. The output of droop gain block 138 is supplied to a positive input of summing node 140. The output of summing node 140 is supplied to another positive input of output summing node 152 and to delay block 144. The output of delay block 144 is supplied to a droop gain block having a gain defined by the equation (K_DROOP–1) and thereafter supplied to another positive input of summing node 134. The output of delay block 144 is further supplied to a gain block 142, where K_DFLT is a fixed gain associated with the derivative portion of the PI'D controller. The output of gain block 142 is supplied to another positive input of summing node 140. Finally, the output of summing node 152 is the output of the PI'D controller which supplies the fuel control signal to actuate the fueling system 28 of the engine 30.

The foregoing PI'D controller 120, as previously discussed, may be implemented as a software algorithm, such as in controller 52 of system 50 (FIG. 5A), or as a system of components, such as in system 70 (FIG. 5B). It should be pointed out that, when the gain variable K_DROOP is equal to 1.0, a standard implementation of isochronous PID controller 16 results. Similarly, when the gain variable K_is between 0 and 1, the variable droop engine speed controller of the present invention results.

Using well known system equations and techniques, the transfer function $H_4$ of PI'D controller 120 is given by the following equation:

$$H_4[(K_DROOP+1)/2][(K_p+K_i+K_d)z^2+(-K_p(K_DFLT+1)-K_iK_DFLT-2K_d)z+(K_pK_DFLT+K_d)]/[(z-K_DFLT)\ (z-K_DROOP)]$$

It should be noted that, in the transfer function $H_4$, the gain term K_DROOP, corresponding to the newly introduced droop gain, does not show up in the numerator polynomial, so it does not affect zero placement. Furthermore, the two poles are located at K_DFLT and K_DROOP so that changing K DROOP changes only one pole. The two zeros are each functions of $K_p$, $K_i$, $K_d$ and K_DFLT. The implementation of PI'D controller 120, as shown in FIG. 8, thus achieves the goals of permitting the steady-state gain to be varied without affecting the dynamic compensation provided by the remaining gains $K_p$, $K_i$, $K_d$ and K_DFLT.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected. For example, the PI'D controller implementation 120 shown in FIG. 8 represents one embodiment of a PI'D controller in accordance with the present invention, and those skilled in the art will recognize that alternate embodiments may be easily configured to implement the concepts set :forth above. It is therefore to be understood that the PI'D controller embodiment 120 is merely representative of the concepts of the present invention. As another example, the PI'D controller described herein, although not shown in the drawings, may be used in a system that varies droop based on specified vehicle and engine operating conditions. Such is considered to be within the spirit of the present invention. As a further example, the droop gain K_DROOP may be increased such that the integral portion pole is greater than unity (Z>1). "Negative" droop can thus be provided by the PID controller of the present invention such that the steady state engine speed increases as engine load increases. Droop, with the PI'D controller of the present invention, may take on a full range of positive and negative values.

What is claimed is:

1. A method of controlling the engine speed of an internal combustion engine having a throttle position sensor associated therewith for sensing throttle position, an engine speed sensor for sensing actual engine speed, and a fuel system responsive to a fuel control signal to fuel the engine, the method comprising the steps of:

(1) sensing throttle position and determining a desired engine speed therefrom;

(2) sensing actual engine speed;

(3) determining an error speed to be the difference between the desired engine speed and the actual engine speed;

(4) generating a fuel control signal from the error speed that is a function of at least the magnitude, duration and rate of change of the error speed, the fuel control signal further being proportional to engine load such that the actual engine speed decreases as engine load increases; and (5) fueling the engine in accordance with the fuel control signal to thereby control the actual engine speed.

2. The method of claim 1 wherein step (4) includes the steps of:

(4)(a) providing a speed error correction function that has at least one pole associated therewith;

(4)(b) subjecting the error speed to the speed error correction function to generate the fuel control signal; and (4)(c) positioning the speed error correction function pole to a location providing a desired ratio of engine speed decrease to engine load increase.

3. The method of claim 1 wherein step (4) includes the steps of:

(4)(a) providing a gain function having a predetermined frequency response;

(4)(b) subjecting the error speed to the gain function to generate the fuel control signal; and (4)(c) adjusting only the steady-state gain of the gain function to provide a desired ratio of engine speed decrease to engine load increase.

4. A method of providing variable droop in an electronic engine speed governor having a proportional portion, an integral portion and a derivative portion associated therewith, the governor having a transfer function that is a function of the proportional, integral and derivative portions, the method comprising the steps of:

(1) configuring the governor such that its transfer function has a pole associated with the integral portion;

(2) providing the integral portion with a droop gain associated with the integral portion pole; and (3) varying the magnitude of the droop gain to thereby vary the location of the integral portion pole, the location of the integral portion pole determining the amount of droop in the engine speed governor.

5. The method of claim 4 wherein step (1) includes configuring the governor such that its transfer function has another pole associated with the derivative portion.

6. The method of claim 5 further including the following step after step (1):

(1)(a) providing the derivative portion with a fixed gain associated with the derivative portion pole.

7. The method of claim 6 wherein step (1) further includes configuring the governor such that its transfer function has at least two zeros associated with a combination of the proportional, integral and derivative portions.

8. The method of claim 7 further including the following steps after step (1)(a):

(1)(b) providing the proportional portion with a proportional gain;

(1)(c) providing the integral portion with an integral gain;

(1)(d) providing the derivative portion with a derivative gain;

wherein the zeros of of the transfer function are each a function of the proportional, integral, derivative and fixed gains.

9. A method of providing variable droop in an electronic engine speed governor having a proportional portion, an integral portion and a derivative portion, the governor having a frequency response associated therewith, the method comprising the steps of:

(1) configuring the governor such that the magnitude of only its steady-state frequency response is dependent upon a droop gain associated with the integral portion; and (2) varying the magnitude of the droop gain to thereby vary the steady state frequency response magnitude, the magnitude of the steady-state frequency response determining the amount of droop in the engine speed governor.

10. The method of claim 9 wherein step (1) further includes configuring the governor such that the magnitude of the dynamic frequency response is a function of at least a proportional gain associated with the proportional portion, an integral gain associated with the integral portion and a derivative gain associated with the derivative portion.

11. A control system for controlling the speed of an internal combustion engine having a throttle comprising:

a throttle position sensor for sensing throttle position and providing a throttle position signal corresponding thereto;

an engine speed sensor for sensing engine speed and providing an engine speed signal corresponding thereto;

a fueling system responsive to a fuel control signal to fuel the engine; and an engine speed controller responsive to said throttle position signal to provide a reference speed signal corresponding thereto, said controller being responsive to said reference speed signal and said engine speed signal to determine an error speed signal corresponding to the difference therebetween, said controller being further responsive to said error speed signal to generate said fuel control signal from said error speed signal, said fuel control signal being a function of at least the magnitude, duration and rate of change of said error speed signal and further being proportional to engine load such that said engine speed decreases as engine load increases.

12. The control system of claim 11 wherein said engine speed controller includes a proportional portion, an integral portion and a derivative portion, said proportional, integral and derivative portions defining an engine speed controller transfer function.

13. The control system of claim 12 wherein said transfer function has a pole corresponding only to said integral portion;

and wherein said integral portion includes a droop gain associated with said integral portion pole.

14. The control system of claim 13 wherein said droop gain is variable to thereby vary the location of said integral portion pole;

and wherein the location of said integral portion pole determines the amount of engine speed decrease to engine load increase.

15. The control system of claim 14 wherein the amount of engine speed decrease to engine load increase defines an engine speed decrease to engine load increase ratio;

and wherein said ratio increases as said droop gain decreases.

16. A variable droop electronic engine speed governor for use in a control system for controlling the speed of an internal combustion engine, comprising:

an error speed input for receiving an engine speed error signal thereat;

a fuel control output for providing a fuel control signal thereat; and an engine speed error correction portion defining a transfer function having at least one pole, the location of said pole being variable to thereby provide said governor with a variable range of droop;

wherein said engine speed governor is responsive to said engine speed error signal to provide said fuel control signal to the engine fueling system in accordance with said transfer function.

17. The control system of claim 16 wherein said engine speed error correction portion includes:

a proportional portion having a proportional gain associated therewith;

an integral portion having an integral gain and a droop gain associated therewith;

a derivative portion having a derivative gain and an auxiliary gain associated therewith;

wherein said transfer function pole is associated only with said droop gain such that the location of said pole is varied by varying the magnitude of said droop gain.

18. A variable droop electronic engine speed governor for use in a control system for controlling the speed of an internal combustion engine, comprising:

an error speed input for receiving an engine speed error signal thereat;

a fuel control output for providing a fuel control signal thereat; and an engine speed error correction portion having a frequency response associated therewith, the magnitude of only the steady-state portion of said frequency response being variable to thereby provide the engine speed governor with a correspondingly variable range of droop;

wherein said engine speed governor is responsive to said engine speed error signal to provide said fuel control signal to the engine fueling system in accordance with said frequency response.

19. The control system of claim 18 wherein said engine speed error correction portion includes:

a proportional portion having a proportional gain associated therewith;

an integral portion having an integral gain and a droop gain associated therewith;

a derivative portion having a derivative gain and an auxiliary gain associated therewith;

wherein said steady-state portion of said frequency response is associated only with said droop gain such that said steady-state frequency response is varied by varying the magnitude of said droop gain.

* * * * *